US009515417B2

(12) United States Patent
Fries et al.

(10) Patent No.: US 9,515,417 B2
(45) Date of Patent: Dec. 6, 2016

(54) SENSOR INTERCONNECT FOR MEDICAL MONITORING DEVICES

(71) Applicant: Covidien LP, Mansfield, MA (US)

(72) Inventors: Timothy W. Fries, Louisville, CO (US); Friso Schlottau, Lyons, CO (US); Sarah Hayman, Boulder, CO (US)

(73) Assignee: Covidien LP, Mansfield, MA (US)

( * ) Notice: Subject to any disclaimer, the term of this patent is extended or adjusted under 35 U.S.C. 154(b) by 0 days.

(21) Appl. No.: 14/573,670

(22) Filed: Dec. 17, 2014

(65) Prior Publication Data

US 2015/0200491 A1 Jul. 16, 2015

Related U.S. Application Data

(60) Provisional application No. 61/927,089, filed on Jan. 14, 2014.

(51) Int. Cl.
*H01R 13/44* (2006.01)
*H01R 13/639* (2006.01)

(52) U.S. Cl.
CPC ..... *H01R 13/639* (2013.01); *H01R 2201/12* (2013.01); *Y10T 29/49174* (2015.01)

(58) Field of Classification Search
CPC ..... H01R 13/447; H01R 13/639
USPC ..... 439/144, 923, 372
See application file for complete search history.

(56) References Cited

U.S. PATENT DOCUMENTS

| | | | | |
|---|---|---|---|---|
| 5,851,178 | A | 12/1998 | Aronow | |
| 6,541,756 | B2 | 4/2003 | Schulz et al. | |
| 7,195,512 | B2 * | 3/2007 | Jenkinson | H01R 13/6395 439/372 |
| 2002/0103423 | A1 | 8/2002 | Chin et al. | |
| 2008/0076980 | A1 | 3/2008 | Hoarau | |
| 2008/0076995 | A1 | 3/2008 | Hoarau | |
| 2008/0076996 | A1 | 3/2008 | Hoarau | |

FOREIGN PATENT DOCUMENTS

| | | | |
|---|---|---|---|
| EP | 1945099 | B1 | 1/2012 |
| JP | 2005052385 | A | 3/2005 |
| JP | 2005110816 | A | 4/2005 |
| JP | 2006061566 | A | 3/2006 |
| JP | 2007117641 | A | 5/2007 |
| JP | 2007167183 | A | 7/2007 |

(Continued)

OTHER PUBLICATIONS

Faisst, Karin, et al.; "Intrapartum Reflectance Pulse Oximetry: Effects of Sensor Location and Fixation Duration on Oxygen Saturation Readings," Journal of Clinical Monitoring, 1997, vol. 13, pp. 299-302.

(Continued)

*Primary Examiner* — Phuong Dinh

(57) ABSTRACT

According to various embodiments, a medical monitoring system includes an extension cable for connecting a medical monitoring device to a sensor cable of a sensor. The extension cable includes a head for accepting a plug of the sensor club, wherein the head includes a lid for restraining the plug within an port of the head of the extension cable. Further, the head includes a hinge configured to allow the lid to rotate about the hinge, wherein the hinge is located within the head such that the head includes substantially flat outer surfaces.

18 Claims, 3 Drawing Sheets

(56) References Cited

FOREIGN PATENT DOCUMENTS

| | | |
|---|---|---|
| JP | 2007167184 A | 7/2007 |
| JP | 2007190122 A | 8/2007 |

OTHER PUBLICATIONS

Izumi, Akio, et al.; "Accuracy and Utility of a New Reflectance Pulse Oximeter for Fetal Monitoring During Labor," Journal of Clinical Monitoring, 1997, vol. 13, pp. 103-108.
"Smaller Product, Tighter Tolerances Pose Dispensing Challenges for Medical Device Manufacturer," Adhesives Age, pp. 40-41, Oct. 1997.
Rhee, Sokwoo, et al.; "The Ring Sensor: a New Ambulatory Wearable Sensor for Twenty-Four Hour Patient Monitoring," Proceedings of the 20th annual International Conference of the IEEE Engineering in Medicine and Biology Society, 1998, vol. 20, No. 4, pp. 1906-19.
Yang, Boo-Ho, et al.; "A Twenty-Four Hour Tele-Nursing System Using a Ring Sensor," Proceedings of the 1998 IEEE International Conference on Robotics & Automation, Leaven, Belgium, May 1998; pp. 387-392.
Ferrell, T.L., et al.; "Medical Telesensors," SPIE, 1998, vol. 3253, pp. 193-198.
Yang, Boo-Ho, et al.; "Development of the ring sensor for healthcare automation," Robotics and Autonomous Systems 30 (2000) pp. 273-281. Received May 21, 1999.
Rhee, Sokwoo, et al.; "Artifact-Resistant, Power-Efficient Design of Finger-Ring Plethysmographic Sensor—Part I: Design and Analysis," Proceedings of the 22nd Annual EMBS International Conference, Chicago, Illinois; Jul. 23-28, 2000; pp. 2792-2795.
Rhee, Sokwoo, et al.; "Artifact-Resistant, Power-Efficient Design of Finger-Ring Plethysmographic Sensor—Part II: Prototyping and Benchmarking," Proceedings of the 22nd Annual EMBS International Conference, Chicago, Illinois; Jul. 23-28, 2000; pp. 2796.
Schulz, Christian Eric; "Design of a Pulse Oximetry Sensor Housing Assembly," California State University Master's Thesis, UMI Dissertation Services, UMI No. 1401306, May 2000.
Yokota, Nakaura, Takahashi, et al.; "Pilot Model of a Reflectance-Type Pulse Oximeter for Pre-hospital Evaluation," Journal of the Japanese Society of Emergency Medicine, KKanto Region, vol. 21, pp. 26-27.
Gisiger, P.A., et al.; "OxiCarbo®, a single sensor for the non-invasive measurement of arterial oxygen saturation and CO2 partial pressure at the ear lobe," Sensor and Actuators, 2001, vol. B-76, pp. 527-530.
Rhee, Sokwoo, et al.; "Artifact-Resistant Power-Efficient Design of Finger-Ring Plethysmographic Sensors," IEEE Transactions on Biomedical Engineering, Jul. 7, 2001, vol. 48, No. 7, pp. 795-805.
Maletras, Francois-Xavier, et al.; "Construction and calibration of a new design of Fiber Optic Respiratory Plethysmograph (FORP)," Optomechanical Design and Engineering, Proceedings of SPIE, 2001, vol. 4444, pp. 285-293.
Earthrowl-Gould, T., et al.; "Chest and abdominal surface motion measurement for continuous monitoring of respiratory function," Proc. Instn Mech Engrs, 2001, V215, Part H; pp. 515-520.
Shaltis, Phillip, et al.; "Implementation and Validation of a Power-Efficient, High-Speed Modulation Design for Wireless Oxygen Saturation Measurement Systems," IEEE, 2002, pp. 193-194.
Warren, Steve, et al.; "Wearable Sensors and Component-Based Design for Home Health Care," Proceedings of the Second Joint EMBS/BMES Conference, Houston, Texas; Oct. 23-26, 2002; pp. 1871-1872.
Matsui, A., et al.; "Pulse Oximeter," Neonatal Care, 2003, vol. 16, No. 3, pp. 38-45.
Nakagawa, M., et al.; "Oxygen Saturation Monitor," Neonatal Monitoring, 2003, vol. 26, No. 5, pp. 536-539.
Urquhart, C., et al.; "Ear probe pulse oximeters and neonates," Anaesthesia, 2005, vol. 60, p. 294.
Bentley, David J. et al.; "Measure Pressure with Thin Film"; Paper Film & Foil Converter; May 1, 2003.
CFW, Sure Code 1500 Printer, Jun. 25, 2008, 4 Pages. http://www.cfw.com.my/fujifilm.htm.
Paul Benjamin Crilly et al., an integrated pulse oximeter system for telemedicine applicaitons, IEE Instrumentation and measurement, technology conference, ottawa canada, May 19-21, 1997, p. 102-104.
Marc Dekock, M.D., Pulse oximetry probe adhesive disks: a potential for infant aspiration, Anesthesiology, V 89, No. 6. Dec. 1998, pp. 1603 & 1604.
A. Irie, Kitasato University Child and Mother Clinic, Respiration monitors-pulse oximeters, Neonatal care, 2002, vol. 15, No. 12.

* cited by examiner

SENSOR INTERCONNECT FOR MEDICAL MONITORING DEVICES

CROSS-REFERENCE TO RELATED APPLICATION

This application claims the benefit of Provisional Application Ser. No. 61/927,089, filed Jan. 14, 2014, entitled "SENSOR INTERCONNECT FOR MEDICAL MONITORING DEVICES", which is incorporated by reference herein in its entirety.

BACKGROUND

The present disclosure relates generally to medical devices and, more particularly, to improved interconnects between a sensor and a monitor.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

In the course of treating a patient, a medical monitoring device may be used by a clinician. The device or monitor may be connected to a sensor disposed on or in the patient. The device may include a connection port for connecting the sensor to the device via a sensor cable. Often times, the sensor may be coupled to the device or monitor via a relatively short sensor cable (e.g., three feet in length). For ease of use, the sensor cable may be mated to an extension cable that spans from a plug of the sensor cable (that normally plugs into the connection port of the device) to the connection port of the medical monitoring device. The extension cable may enable the patient to move freely without disconnecting the sensor from the medical monitoring device. Because the sensor cable may be relatively short, a head or sensor interconnect of the extension cable, which receives the sensor cable's plug, may often be located in the patient's bed. Further, the head of the extension cable may include protrusions and/or other irregular geometries. As such, the patient may experience discomfort when he or she rolls on top of the head of the extension cable. Additionally, the protrusions may catch on sheets or other articles in and/or adjacent to the patient's bed, causing the sensor to fall off the patient and/or the sensor cable to unplug. Therefore, there is a need for an improved configuration of the head of the extension cable that does not discomfort the patient and does not cause the sensor cable to unplug or detach from the patient unintentionally.

BRIEF DESCRIPTION OF THE DRAWINGS

Advantages of the disclosed techniques may become apparent upon reading the following detailed description and upon reference to the drawings in which.

DETAILED DESCRIPTION OF SPECIFIC EMBODIMENTS

Figure 1:
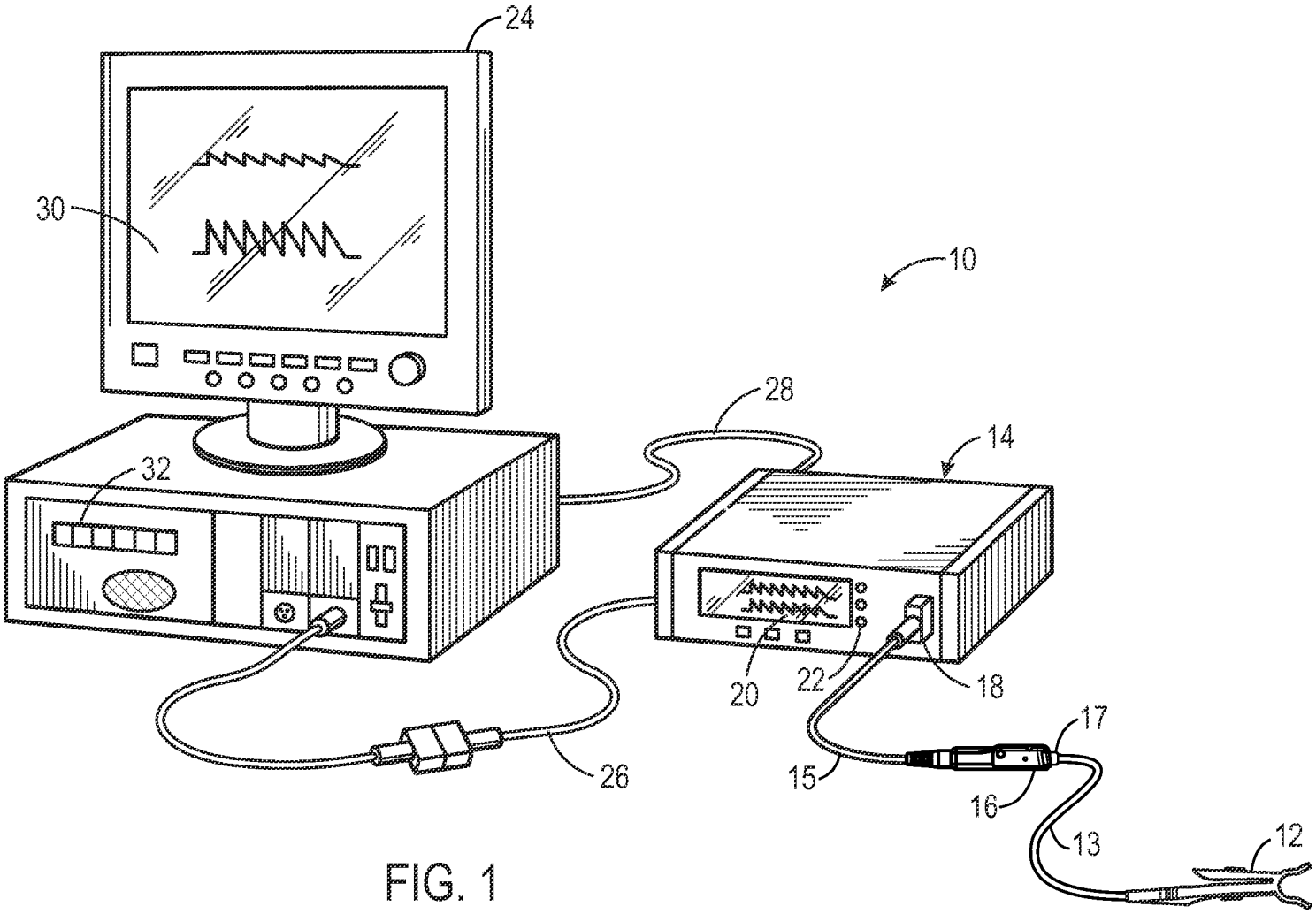
FIG. 1 illustrates a medical monitoring system (e.g., monitor coupled to sensor via multiple cables) coupled to a multi-parameter patient monitor according to an embodiment.

One or more specific embodiments of the present techniques will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. The term "metric" refers to a specific set of analyzed data, and the term "widget" refers to a collection of related metrics. The term "component" refers to a computer-related entity, either a combination of hardware and software, software, or software in execution. The term "end user" is intended to be a layperson who would not typically possess the programming or software engineering knowledge that a specialist (e.g., programmer, software developer, IT technician) would posses.

A clinician may use a medical monitoring device, such as a pulse oximeter, to monitor certain physiological parameters of a patient. The physiological parameters may be obtained using a sensor disposed either externally on or internally within the patient. Examples of monitored physiological parameters may include body temperature, pulse rate, respiration rate, blood pressure, blood oxygenation, or electrical activity or any other physiological parameter. Signals from the sensor may be sent to the monitoring device via an electrical or optical conductor, such as a sensor cable, by connecting a plug of the sensor cable to a connection port of the monitoring device. In addition, signals from the monitoring device may pass through the electrical or optical conductor to the sensor. Some sensors may require power that is provided via the monitoring device.

A medical monitoring device may be used in a variety of settings, which may include operating rooms, intensive care units, recovery rooms, general care floors, and examination rooms. Depending on the particular circumstances, the sensor may be attached to the patient and in electrical communication with the monitoring device for an extended period of time. As such, because a sensor cable (used to couple the sensor to the monitoring device) is often relatively short (e.g., three feet in length), an extension cable may be required as an interconnect between the plug of the sensor cable and the connection port of the monitoring device to facilitate relatively free movement for the patient in the patient's bed. However, a bulky and/or irregularly shaped connection between the extension cable and the sensor cable may cause discomfort to the patient because the connection is often configured such that a head or sensor interconnect of the extension cable that receives the plug of the sensor cable is in the patient's bed, causing the patient to lie, or roll, on top of the head. In other words, odd geometries of the extension cable's head or sensor interconnect may cause discomfort to the patient for the same reason. Additionally, irregular protrusions from the extension cable's head may catch or snag on sheets or other articles adjacent to the head, causing the sensor cable to unplug or detach from the patient.

In certain embodiments below, the head or sensor interconnect of the extension cable includes a port (e.g., a sensor port) configured to receive and couple to the plug of the sensor cable. The port is configured to electrically couple the sensor cable to the extension cable, while the extension cable is coupled to the connection port of the monitoring device. Further, the head may include a lid (e.g., latching door) that couples to a body of the head and secures the plug of the sensor cable within the port of the extension cable. The body of the head may include a top side, a bottom side (disposed opposite the top side), and two parallel sides disposed opposite each other between the top and bottom sides along a longitudinal axis of the head. The lid is configured to span all or a portion of one or more sides (excluding the bottom side) of the body of the head of the extension cable along the longitudinal axis. The lid may be attached to the body via a hinge. A hinge point for the hinge is disposed below the top side of the body (e.g., along the sides between the top side and bottom side). The lid may be configured such that it includes a smooth top and two smooth sides. Further, the top and two sides of the lid may fit over the body of the head of the extension cable such that the top of the lid is smooth and in plane with the top of the body and the sides of the lid are smooth and in plane with the respective sides of the body that the sides of the lid are configured to cover. As such, the top, bottom, and sides of the body, along with the top and sides of the lid in a closed position, are substantially smooth, with no major protrusions. Additionally, in certain embodiments, the top, bottom, and sides of the body, along with the top and sides of the lid in the closed position, are substantially flat, or a subset of the above referenced sides are flat, with no major protrusions. In particular, the top side of the body, along with the top side of the lid, may form a continuous flat and/or smooth surface when the lid is in the closed position. Thus, the patient may come in to contact with (e.g., roll on top of) the head of the extension cable without experiencing substantial discomfort. Additionally, the head of the extension cable may come into contact with sheets or other articles adjacent to the head of the extension cable without the sensor unplugging and/or detaching from the patient.

Additionally, the body may include an angled side disposed between the top side, the bottom side, and the two sides of the body and opposite the cable portion of the extension cable. The bottom side may extend axially farther than the top side along the longitudinal axis, wherein the angled side may be angled such that it is coupled to the ends of both the top side and the bottom side, in addition to the ends of the two sides of the body. In other words, the top side may be axially offset from the bottom side. The lid may include an adjacent angled side (i.e., relative to the angled side of the body of the head) between the top and two sides of the lid, such that the angled side of the lid fits over the angled side of the body. The angled side of the body may partially surround and partially enclose the port (e.g., the angled side is outside the port of the body) of the head of the extension cable, such that the plug of the sensor cable is housed within the port of the body and a portion of the angled side (e.g., side portions) of the lid fits over a portion of the plug. As such, the angled side of the lid may be configured to enable the sensor cable to pass through an opening in the angled side. The angled side may include a U-shape or have a recessed cutout that fits over the sensor cable such that the side portions of the angled side may retain the plug within the port of the body while also the U-shape or recessed cutout enables the sensor cable to extend out of the port and beyond the angled side.

In certain embodiments, the disclosed medical monitoring devices, systems, and methods may be used in conjunction with monitoring of any appropriate physiological parameter, such as, but not limited to temperature, pulse rate, respiration rate, blood pressure, blood oxygenation, or electrical activity. The present techniques may also be used on devices used to treat any patient connected to any medical device.

One embodiment of a medical monitoring system 10, in this case a pulse oximetry system, is depicted in FIG. 1. In particular, FIG. 1 depicts the medical monitoring system 10 with a sensor 12 having a sensor cable 13, wherein the sensor cable 13 is coupled to a monitor 14 (e.g., pulse oximeter) via an interconnecting extension cable 15, or cord, in accordance with an embodiment of the present disclosure. The extension cable 15 may include a head 16 (e.g., sensor interconnect) and span between a plug 17 of the sensor cable 13 and a connection port 18 of the monitor 14. The plug 17 of the sensor cable 13 is received into a portion of the head 16 of the extension cable 15. In some embodiments, the head 16 of the extension cable 15 may include a chip, a PCB, or some other component configured to process signals received from the sensor cable 13. The extension cable 15 may carry the processed signals to the connection port 18 of the monitor 14. In other embodiments, the extension cable 15 may be configured to relay signals from the sensor cable 13 directly to the connection port 18 of the monitor 14, such that the monitor 14 may process the signals from the sensor cable 13." The monitor 14 may be any suitable monitor, such as those available from Nellcor Puritan Bennett, LLC. The monitor 14 may be configured to calculate physiological parameters from signals received from the sensor 12 when the sensor 12 is placed on a patient. In some embodiments, the monitor 14 may be primarily configured to determine, for example blood and/or tissue oxygenation and perfusion, respiratory rate, respiratory effort, continuous non-invasive blood pressure, cardiovascular effort, glucose levels, level of consciousness, total hematocrit, hydration, electrocardiography, temperature, or any other suitable physiological parameter. Additionally, the monitor 14 may include a display 20 configured to display information regarding the physiological parameters, information about the system, and/or alarm indications. The monitor 14 may include various input components 22, such as knobs, switches, keys and keypads, buttons, etc., to provide for operation and configuration of the monitor.

Furthermore, to upgrade conventional operation provided by the monitor 14 to provide additional functions, the monitor 14 may be coupled to a multi-parameter patient monitor 24 via a cable 26 connected to a sensor input port or via a cable 28 connected to a digital communication port. In addition to the monitor 14, or alternatively, the multi-parameter patient monitor 24 may be configured to calculate physiological parameters and to provide a central display 30 for information from the monitor 14 and from other medical monitoring devices or systems. In some embodiments, the multi-parameter monitor 24 may be primarily configured to display and/or to determine some or all of the same physiological parameters as the monitor 14. The multi-parameter monitor 24 may include various input components 32, such as knobs, switches, keys and keypads, buttons, etc., to provide for operation and configuration of the multi-parameter monitor 24. In addition, the monitor 14 and/or the multi-parameter patient monitor 24 may be connected to a network to enable the sharing of information with servers or other workstations.

The sensor 12 may be any sensor suitable for detection of any physiological parameter. The sensor 12 may include optical components (e.g., one or more emitters and detectors), acoustic transducers or microphones, electrodes for measuring electrical activity or potentials (such as for electrocardiography), pressure sensors, motion sensors, temperature sensors, etc. In one embodiment, the sensor 12 may be configured for photo-electric detection of blood and tissue constituents. For example, the sensor 12 may be a pulse oximetry sensor, such as those available from Nellcor-Puritan Bennett. As shown in FIG. 1, the sensor 12 may be a clip-type sensor suitable for placement on an appendage of a patient, e.g., a digit, an ear, etc. In other embodiments, the sensor 12 may be a bandage-type sensor having a generally flexible sensor body to enable conformable application of the sensor to a sensor site on a patient. In yet other embodiments, the sensor 12 may be secured to a patient via adhesive (e.g., in an embodiment having an electrode sensor) on the underside of the sensor body or by an external device, such as headband or other elastic tension device. In yet other embodiments, the sensor 12 may be configurable sensors capable of being configured or modified for placement at different sites (e.g., multiple tissue sites, such as a digit, a forehead of a patient, etc.).

Regardless of the configuration of the sensor 12, the sensor cable 13 (and the sensor 12) may be coupled to the monitor 14 via the extension cable 15, as discussed above. The sensor cable 13 may be directly coupled to the extension cable 15 by fitting the plug 17 of the sensor cable 13 into the head 16 (e.g., sensor interconnect) of the extension cable 15.

Figure 2:
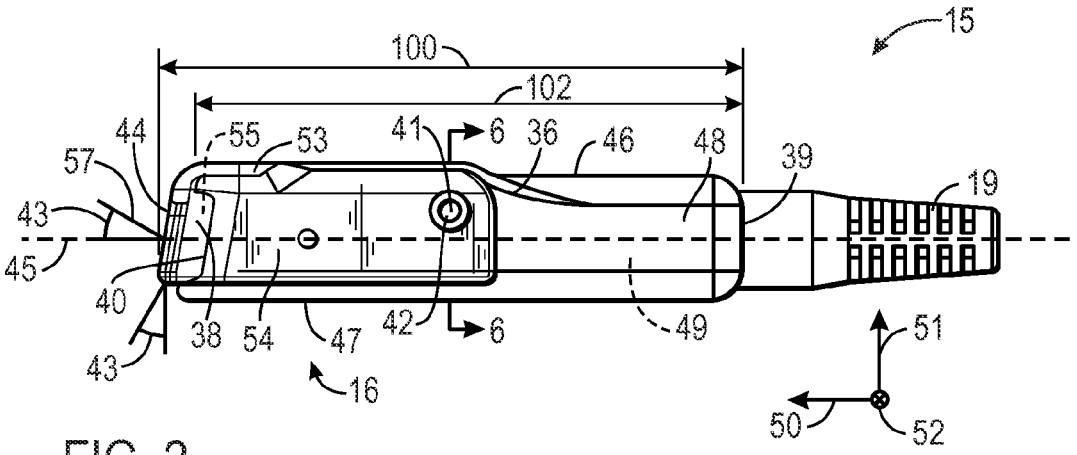
FIG. 2 is a side view of a head or sensor interconnect of an extension cable for connecting a sensor cable of the sensor to the monitor of FIG. 1, according to an embodiment.

As shown in FIG. 2, the head 16 may include a body 36, a lid 38, an end 39 of the body 36 coupled to the cable portion 19 of the extension cable 15, an input opening or port 40 of the body 36 opposite the end 39, and a hinge 41 at hinge point 42. The head 16 may be configured such that the port 40 receives the plug 17 of the sensor cable 13 for electrically coupling the sensor cable 13 (and, thus, the sensor 12) to the monitor 14, provided the extension cable 15 is coupled to the monitor 14 via the connection port 18. The lid 38 is configured to move between an open position and a closed position (see FIG. 3) via the hinge 41. The lid 38 is configured to close (via the hinge 41) over the plug 17 of the sensor cable 13 to secure the plug 17 within the port 40 of the head 16. A portion of the lid 38 oriented at an angle 43 (i.e., angled side 44) may be located adjacent to and outside the port 40 and the body 36 and may restrain the plug 17 within the port 40 by enclosing a portion of the plug 17 within the port 40 as mentioned above. However, pulling the sensor cable 13 away from the head 16 of the extension cable 15 with sufficient force may release, or lift, the lid 38 (e.g., to the open position) via rotation about the hinge 41 such that the lid 38 and/or hinge 41 will not break. The mechanism by which this release is made possible relates to the angle 43 of the angled side 44 of the lid 38 with respect to the placement of the hinge 41 within and/or on the body 36 of the head 16, and is discussed in detail below.

As shown in the illustrated embodiment, the body 36 of the head 16 may extend along a longitudinal axis 45 and include the end 39, the port 40, a top side 46, a bottom side 47, and two sides 48, 49 (e.g., parallel sides), wherein the two sides 48, 49 are disposed between the top side 46 and the bottom side 47. The top side 46 and the bottom side 47 of the body 36 may be substantially parallel to one another, and in plane with directions 50, 52. The bottom side 47 may extend farther from the end 39 of the body 36 than does the top side 46 (e.g., the top side 46 is axially offset from the bottom side 47) along the longitudinal axis 45, as indicated by arrows 100 and 102, respectively. The length of the bottom side 47 along the longitudinal axis 45, indicated by arrow 100, may be greater than the length of the top side 46 along the longitudinal axis 45, indicated by arrow 102. This may enable the angled side 44 of the lid 38 to fit over the port 40 of the body 36. In other words, a slope generated by the different lengths of the bottom side 47 and the top side 46 of the body 36 as described above may enable the angled side 44 of the lid to fit over the port 40 of the body 36 at the angle 43. The two sides 48, 49 of the body 36 may be substantially parallel to one another, and in plane with directions 50, 51. The lid 38 disposed on the body 36 may include a top side 53 and two sides 54, 55, in addition to the angled side 44 as discussed above. The angled side 44 of the lid 38 in the illustrated embodiment may be disposed over the port 40 the body 36 of the head 16 (and, thus, over the plug 17 of the sensor cable 13 received within the port 40) and opposite the cable portion 19 of the extension cable 15. The hinge 41 is located in a plane defined by directions 50 and 51 at the hinge point 42, wherein the hinge point 42 is located below the top side 46 and above the bottom side 47 of the body 36. Generally, the hinge point 42 may be located closer to the top side 46 than the bottom side 47. For example, the hinge point 42 may be located a quarter, a third, or half of the distance between the top side 46 and the bottom side 47 starting from the top side 46 of the body 36, or any distance therebetween. Further, the hinge point 42 is generally located away from the port 40 of the body 36. In the illustrated embodiment, the hinge point 42 is approximately half way between the port 40 of the body 36 and the cable portion 19 of the extension cable 15 along direction 50. In general, the hinge point 42 may be located approximately half way or more toward the end 39 of the body 36 from the port 40. In some embodiments, as will be discussed in detail later, the lid 38 may extend closer to the end 39 of the extension cable 15, wherein the hinge point 42 is also located closer to the end 39. For example, the hinge point 42 may be located approximately halfway between the port 40 of the body 36 and the cable portion 19 of the extension cable 15 from the port 40, approximately two thirds the distance, approximately three fourths the distance, approximately at the cable portion 19, or any distance therebetween, measured starting from the port 40 of the body 36.

Focusing on the connection between the sensor cable 13 and the extension cable 15, the angled side 44 of the lid 38 includes angled side portions 56 which partially cover the port 40 of the body 36 and the plug 17 residing within the port 40. As such, attempts to pull the plug 17 (e.g., in direction 50) via the sensor cable 13 out of the port 40 will cause a portion of the plug 17 to contact the angled side portions 56 of the angled side 44 of the lid 38. By pulling either the sensor cable 13 or the extension cable 15 away from the connection between the same, a normal force 57 is generated from the pulling force on the angled side 44 by the plug 17, wherein the normal force 57 is perpendicular to the angled side 44 (i.e., the normal force 57 is angled at angle 43 with respect to the longitudinal axis 45 that extends through the hinge 41). Because the normal force 57 is not directed in line with the hinge 41 (i.e., the normal force 57 is directed at angle 43 to the longitudinal axis 45), a torque 58 is generated about the hinge 41 connecting the lid 38 to the body 36 of the head 16. As such, a sufficient normal force 57 generated by pulling the plug 17 against the angled side 44 may lift the lid 38 via the torque 58 exerted on the hinge 41, enabling the removal or disconnection of the plug 17 from the head 16. Further, the configuration of the angled side 44 may enable the hinge 41 to be located below the top 46 and above the bottom 47 of the body 36 of the head 16 of the extension cable 15, allowing for a generally smoother geometry of the head 16 to minimize potential pressure points.

Additionally, the angled side 44 of the lid 38 of the present embodiment may be configured such that the normal force 57 must reach a certain threshold to provide enough torque 58 to open the lid 38. In other words, the smaller the angle 43 of the angled surface 44 is with respect to the direction the plug 17 is pulled from the port 40 (e.g., direction 50 or along longitudinal axis 45), the greater the normal force 57 required to open the lid 38 and, additionally, the greater the force required to be exerted to disconnect the extension cable 15 from the sensor cable 13. Accordingly, the angled side 44 may be angled at angle 43 from the longitudinal axis 45. The angle 43 may be in the range of greater than zero up to approximately 90 degrees, greater than zero up to approximately 45 degrees, approximately 10-35 degrees, or approximately 20-25 degrees, and all sub ranges therebetween, depending on the desired normal force 57 threshold. As such, the pulling force exerted to exceed the normal force 57 threshold to pull the plug 17 of the sensor cable 13 out of the port 40 of the head 16 of the extension cable 15 may range from approximately 10-30 pounds force (lbf.) (approximately 44.5 to 133.5 newtons) depending on the configuration.

In the closed position with the extension cable 15 coupled to the sensor cable 13 (e.g., in the illustrated embodiment of FIG. 2, but with the sensor cable 13 coupled to the extension cable 15 in the manner discussed above), the top side 53 of the lid 38 may be disposed over, and in plane with, all or a portion of the top side 46 of the body 36. Further, the two sides 54, 55 of the lid 38 may be disposed over, and in plane with, all or a portion of the two sides 48, 49 of the body 36, respectively. In other words, the lid 38 is configured to fit over the body 36 such that, when the lid 38 is in a closed position, the head 16 (e.g., sensor interconnect) includes substantially smooth surfaces. In certain embodiments, the head 16 includes substantially flat surfaces. It should be noted that the lid 38 may cover all or a portion of the top side 46 and/or sides 48, 49 of the body 36 of the head 16 of the extension cable 15. Further, the hinge 41 may be located at the position in the illustrated embodiment (e.g., hinge point 42) or at other locations along direction 50 between the top 46 and the bottom 47 of the body 36. In other words, the hinge point 42 may be located at different points along direction 50 so long as the hinge point 42 and hinge 41 are entirely below the top 46 and above the bottom 47 of the body 36 and opposite the side of the head 16 with the port 40. In general, the hinge point 42 may be located on the head 16 toward the end of the head 16 opposite the angled side 44 and port 40 of the body 36. Further, while the hinge point 42 is generally located below the top side 46 of the body 36 and above the bottom side 47 of the body 36, it may be located closer to the top side 46 than the bottom side 47, as discussed with respect to a previous embodiment.

Additionally, the head 16 may be configured such that normal forces 57 generated by ordinary maneuvers by the patient may not disconnect the plug 17 of the sensor cable 13 from the port 40 of the head 16 of the extension cable 15. Thus, the extension cable 15 may remain electrically coupled to the sensor cable 13 unless an unordinary maneuver occurs. For example, if the patient falls from the patient's bed and the cables experiences tension in the range of forces discussed above, the cables may disconnect without damage to the head 16 of the extension cable 15 and/or plug 17 of the sensor cable 13. However, if the patient simply rolls over and the cables experience tension below the range of forces discussed above, the cables may remain coupled.

Figure 3:
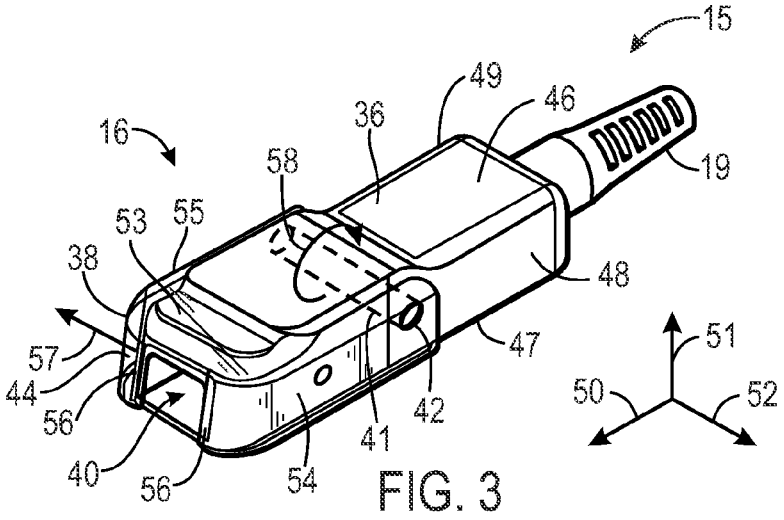
FIG. 3 is a perspective view of a head of the extension cable of FIG. 2 having a closed lid, according to an embodiment.
Figure 4:
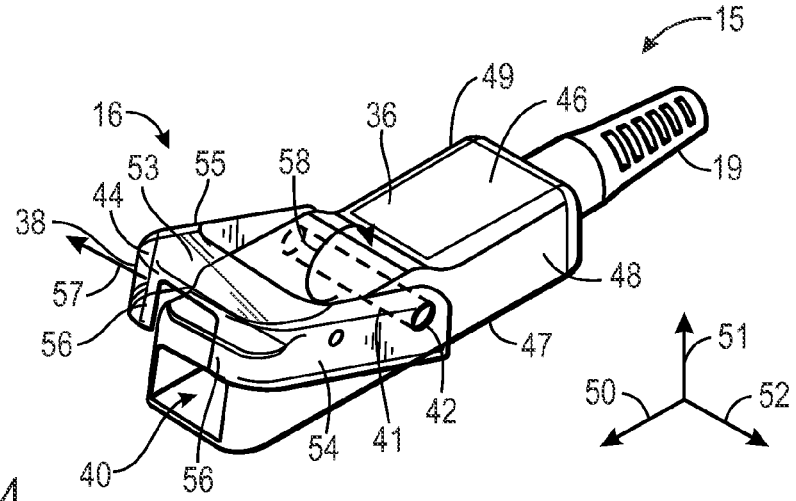
FIG. 4 is a perspective view of a head of the extension cable of FIG. 2 having an open lid, according to an embodiment.

Turning now to FIGS. 3 and 4, perspective views of the head 16 of the extension cable 15 are illustrated in accordance with an embodiment. As discussed above, the lid 38 is disposed over a portion of the body 36 of the head 16, wherein the angled side 44 of the lid 38 may restrain the plug 17 of the sensor cable 13 within the port 40 of the head 16, such that the sensor cable 13 is in electrical communication with the extension cable 15. Focusing on the illustrated embodiment of FIG. 4, the head 16 is shown with the lid 38 in an open position. The angled side 44 includes the angled side portions 56 which partially cover the port 40 and the plug 17 residing within the port 40. As such, when the lid 38 is in the closed position, attempts to pull the plug 17 via the sensor cable 13 out of the port 40 will cause a portion of the plug 17 to contact the angled sides 56 of the angled side 44 of the lid 38, such that the lid 38 may rotate about the hinge 41 and lift as set forth above.

Figure 5:
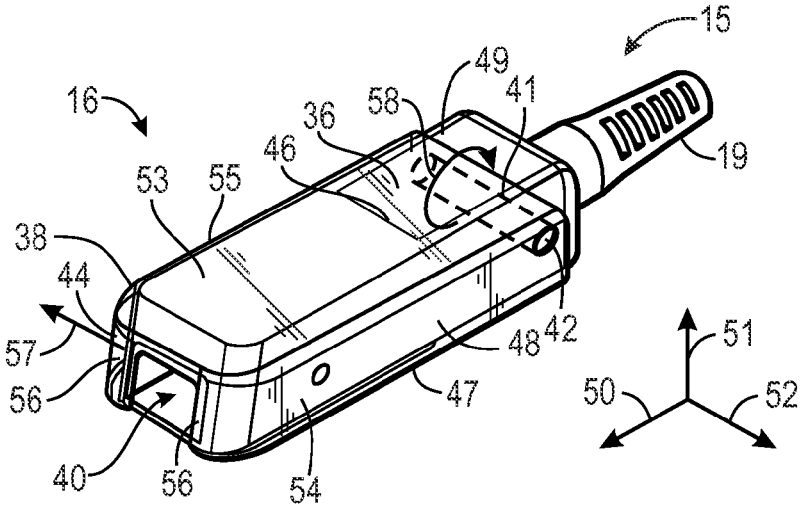
FIG. 5 is a perspective view of a head of the extension cable of FIG. 2 (e.g., having a longer top portion of a lid), according to an embodiment.

In certain embodiments discussed above, the lid 38 is illustrated covering only a portion of the body 36 of the head 16 of the extension cable 15 (e.g., the embodiment in FIG. 2 is approximately 50% coverage). However, an embodiment of the head 16 may include the lid 38 covering substantially the entirety of the body 36 of the head 16, as illustrated in the perspective view of FIG. 5. Indeed, the lid 38 may cover a quarter, a half, three quarters, the entirety, or any other amount of the body 36 of the head 16. The lid 38 may cover the body 36 of the head 16 in the range of approximately 10 to 100 percent coverage, 30 to 80 percent coverage, 50 to 60 percent coverage, or any subrange therebetween. The coverage of the lid 38 may partially dictate the location of the hinge 41, as illustrated in FIGS. 3-5. Because torque is equal to force multiplied by distance, the distance of the hinge point 42 from the angled side 44 (i.e., the distance along direction 50 between the location where the normal force 55 is applied to the lid 38 and the location where the lid 38 rotates about (i.e., the hinge point 42)) may affect the torque 58 generated about the hinge 41. In other words, the further the hinge point 42 is located away from the angled side 44 along direction 50, the greater the torque 58 will be about the hinge 41. Thus, the lid 38 may be configured to at least partially determine the normal force 57 threshold needed to lift the lid 38 as discussed above. Additionally, in the illustrated embodiment, the lid 38 includes substantially flat sides (e.g., sides 48, 49, and angled side 44) and covers substantially the entirety of the top side 53 of the body 36. In other words, the head 16 includes substantially flat sides such that the head 16 does not include irregular protrusions that may discomfort the patient or catch on sheets or other articles adjacent the head 16.

Figure 6:
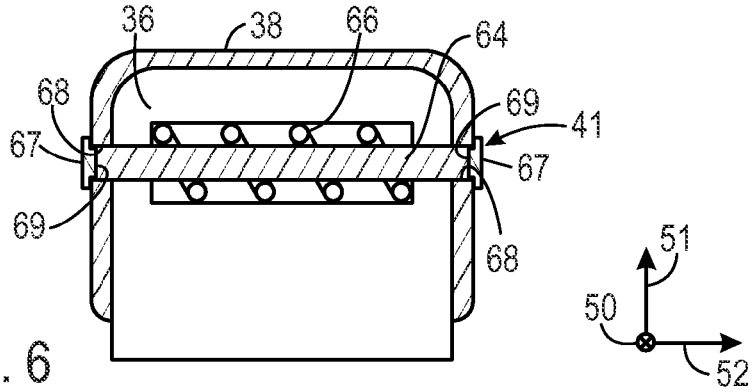
FIG. 6 is a cross sectional view of a hinge assembly for a lid of the head of the extension cable of FIG. 2, taken along line 6-6 of FIG. 2, according to an embodiment.
Figure 7:
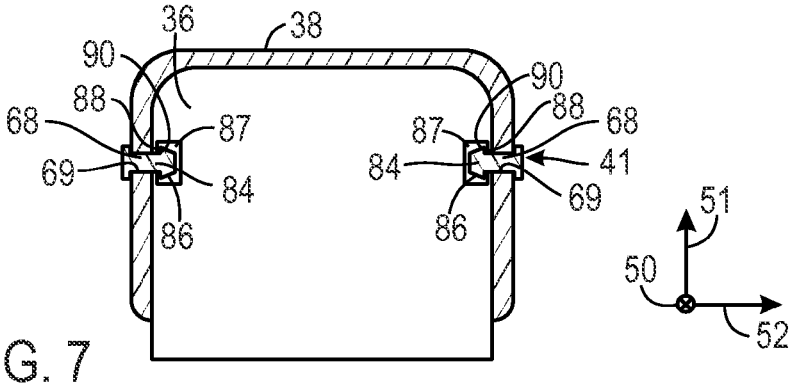
FIG. 7 is a cross sectional view of a hinge assembly for the lid of the head of the extension cable of FIG. 2, taken along line 6-6, according to an embodiment.

Different embodiments of the hinge 41 are illustrated in FIGS. 6 and 7. In FIG. 6, the hinge 41 may include a pin or cylindrical bearing 64 and may additionally include a spring 66. The cylindrical bearing 64 extends through the body 36 in direction 52. The hinge 41 is configured to couple the lid 38 to the body 36 of the head 16 of the extension cable 15 and enable the lid 38 to pivot about the hinge 41. In certain embodiments, the cylindrical bearing 64 may be a part of the body 36 (i.e., the cylindrical bearing 64 may be a cylindrical surface of the body 36). In another embodiment, the cylindrical bearing 64 may be a separate element from the body 36, wherein the cylindrical bearing 64 is fixed to the body 36 in some manner, permanently or otherwise, such that it does not rotate, allowing the lid 38 to rotate freely about the cylindrical bearing 64. In still another embodiment, the cylindrical bearing 64 may be a separate element from the body 36, wherein the cylindrical bearing 64 is configured to rotate freely, or in conjunction with the lid 38. For example, in accordance with certain embodiments, the cylindrical bearing 64 may have retention components or caps 67 on either end 68 of the cylindrical bearing 64 to keep the lid 38 from falling off the body 36 of the head 16. Further, the caps 67 may retain the cylindrical bearing 64 in place within the body 36. The caps 67 may be flat circular disks radially centered on either end 68 of the cylindrical bearing 64 and located outside of the lid 38, but with a greater diameter than that of the cylindrical bearing 64 and that of openings 69 in the lid 38 through which the cylindrical bearing 64 extends. As such, the retention pieces or caps 67 may substantially block the lid 38 from moving in all degrees of freedom other than rotation about the hinge 41 (i.e., rotation about an axis in direction 52). Further, the caps 67 may block the cylindrical bearing 64 from sliding out of either of the openings 69 in the lid 38. As such, the cylindrical bearing 64 may be configured to be a separate component from the body 36 of the head 16 and thus may rotate freely relative to the body 36 while still allowing the lid 38 to rotate about the cylindrical bearing 64. Or, in another embodiment, the cylindrical bearing 64 may include the caps 67 and include some other element (e.g., a hook, a welded portion, or an adhesive) that fixes the cylindrical bearing 64 to the body 36, such that the cylindrical bearing 64 is substantially restrained in all degrees of freedom and only the lid 38 is configured to rotate about the hinge 41 (e.g., the cylindrical bearing 64). In still another embodiment, the cylindrical bearing 64 may be a part of the lid 38 and not attached to the body 36 of the head 16 (e.g., the cylindrical bearing 64 may be coupled to the lid 38 at the openings 69 instead of extending through the openings 69 in the lid 38), wherein the lid 38 and cylindrical bearing 64 are configured to rotate together with respect to the head 16. It should be noted that the above referenced embodiments of the cylindrical bearing 64, and the hinge 41 in general, are merely representative of certain configurations of the present disclosure and that any other combination of these embodiments would not be considered as materially departing from the present disclosure to one of ordinary skill in the art.

Additionally, in accordance with an embodiment, the spring 66 may be disposed about the cylindrical bearing 64 discussed above and contact a portion of the lid 38, wherein the cylindrical bearing 64 is not configured to be a part of the lid 38. The spring 66 may be configured to be in compression such that rotation of the lid 38 about the cylindrical bearing 64 may increase the compression and, thus, the spring force in the spring 66. As such, the spring 66 may be included to at least partially determine the normal force 55 threshold as discussed above for opening the lid 38. In other words, a greater spring force required to rotate the lid 38 about the cylindrical bearing 64 may require a greater normal force 55 and, thus, a greater pulling force on the plug 17 to separate the extension cable 15 from the sensor cable 13.

In certain embodiments, the hinge 41 may include snap-on bearing elements 84 as shown in FIG. 7. The snap-on bearing elements 84 may each include an angled surface 86 such that the snap-on bearing elements 84 may be inserted through the openings 69 in the lid 38 and into the body 36 of the head 16. The angled surface 86 may be configured to compress radially inward during insertion of the snap-on bearing element 84 through the openings 69 of the lid 38 and into a recess 87 (e.g., cylindrical cut out) of the body 36. Upon insertion, the angled surface 86 may snap radially outward such that a circumferential surface 88 of the snap-on bearing element 84 contacts an inner surface 90 of the recess 87. In one embodiment, the circumferential surface 88 may not always contact the inner surface 90, but the inner surface 90 may constrain the snap-on bearing element 84 from exiting the cylindrical cutout 86. Further, the recess 87 may be a cylinder or some other shape. For example, the recess 87 may include some other shape (e.g., a triangle or square) that receives the snap-on bearing element 84 (wherein the snap-on bearing element 84 may be shaped similarly to the recess 87) and keeps the snap-on bearing element 84 from easily escaping the recess 87. Additionally, each snap-on bearing element 84 may include the cap 67 as discussed in previous embodiments. The snap-on bearing element 84 configuration discussed above may substantially restrain the element 84 from all degrees of freedom other than axial rotation. In another embodiment, however, the snap-on bearing element 84 may also be fixed to the body 36 of the head 16 such that it does not rotate, and only the lid 38 may rotate about each snap-on bearing element 84. In still another embodiment, the snap-on bearing elements 84 may be integral to the lid 38. In other words, the snap-on bearing elements 84 may couple to the lid 38 and rotate simultaneously with the lid 38 about the hinge 41 with respect to the body 36. Further, in one embodiment, each snap-on bearing element 84 may include a manual actuation mechanism that may be initiated with the snap-on bearing element 84 inserted into the recess 87, wherein the manual actuation mechanism compresses the angled surface 86 radially inwards such that the snap-on bearing element 84 may be removed from the recess 87 in the body 36 of the head 16. It should be noted that the above referenced embodiments of the snap-on bearing elements 84, and the hinge 41 in general, are merely representative of certain configurations of the present disclosure and that any other combination of these embodiments would not be considered as materially departing from the present disclosure to one of ordinary skill in the art.

While the disclosure may be susceptible to various modifications and alternative forms, specific embodiments have been shown by way of example in the drawings and have been described in detail herein. However, it should be understood that the embodiments provided herein are not intended to be limited to the particular forms disclosed. Rather, the various embodiments may cover all modifications, equivalents, and alternatives falling within the spirit and scope of the disclosure as defined by the following appended claims.

What is claimed is:

1. An extension cable for a medical monitoring device, the extension cable comprising:

a cable component configured to couple to a monitor; and a sensor interconnect component, comprising:

a body coupled to the cable component;

a port in the body configured to receive a plug from a sensor cable; and a lid disposed over a portion of the body, wherein the lid is configured to move between a closed position and an open position, the lid includes an angled side configured to be partially disposed over the port to secure the plug within the port, and the lid is coupled to the body via a hinge mechanism disposed between a first side and a second side of the body, and wherein the lid includes a smooth side configured to be disposed over a portion of the first side of the body, and the smooth side of the lid and the first side of the body form a continuous, smooth surface when the lid is in the closed position.

2. The extension cable of claim 1, wherein the first side is axially offset from the second side along a longitudinal axis of the body.

3. The extension cable of claim 2, wherein the first side has a first length along the longitudinal axis and the second side has a second length along the longitudinal axis, and the first side has a shorter length than the second side.

4. The extension cable of claim 1, wherein the body comprises a third side and a fourth side that extend between the first and second sides along the longitudinal axis, and the hinge mechanism extends from the third side to the fourth side.

5. The extension cable of claim 1, wherein the smooth side of the lid and the first side of the body form a continuous, flat surface when the lid is in the closed position.

6. The extension cable of claim 1, wherein the angled side of the lid is configured to transfer a torque to the hinge mechanism when the plug of the sensor cable contacts the angled side, enabling the lid to move from the closed position to the open position.

7. An extension cable for a medical monitoring device, the extension cable comprising:

a cable component; and a sensor interconnect component, comprising:

a body coupled to the cable component;

a port in the body configured to receive a plug from a sensor cable; and a lid disposed over a portion of the body, wherein the lid is configured to move between an open position and a closed position, the lid includes a first side extending between a second and third side of the lid, the first side of the lid is configured to be disposed over a first side of the body, and the first side of the lid and the first side of the body form a continuous smooth surface when the lid is in the closed position, and wherein the first side of the lid and the first side of the body form a continuous flat surface when the lid is in the closed position.

8. The extension cable of claim 7, wherein a fourth side of the lid extends over the port of the body configured to receive the plug from the sensor cable, and the fourth side of the lid is angled relative to a longitudinal axis of the body.

9. The extension cable of claim 8, wherein the body comprises the first side and a second side, wherein the first side is axially offset from the second side along the longitudinal axis of the body, such that a third side of the body having the port configured to receive the plug from the sensor cable is angled relative to the longitudinal axis and substantially parallel with the fourth side of the lid.

10. The extension cable of claim 9, wherein the first side of the body has a first length along the longitudinal axis and the second side of the body has a second length along the longitudinal axis, and the first length is shorter than the second length.

11. The extension cable of claim 9, wherein the sensor interconnect component comprises a hinge mechanism configured to couple the lid to the body and configured to enable the lid to move between the closed position and the open position.

12. The extension cable of claim 11, wherein the hinge mechanism is disposed between the first and second sides of the body and the hinge mechanism extends between a fourth and fifth side of the body.

13. A method of manufacturing an extension cable for a medical monitoring system, the method comprising:

providing a body of a sensor interconnect component of the extension cable, wherein the body comprises a port configured to receive a plug from a sensor cable;

coupling a lid to the body, wherein the lid is configured to be disposed over a portion of the body, the lid is configured to move between a closed position and an open position, the lid includes an angled side configured to be partially disposed over the port to secure the plug within the port, and the lid includes a smooth side extending from the angled side and disposed over a first side of the body, wherein the smooth side of the lid and the first side of the body form a continuous, smooth surface;

providing a hinge mechanism configured to couple the lid to the body, wherein when the plug of the sensor exerts a force against the angled side of the lid, the hinge mechanism rotates about a hinge point, enabling the lid to move from the closed position to the open position, enabling the plug to be removed from the port; and coupling a cable component of the extension cable to the body of the extension cable, wherein the cable component is configured to couple to a monitor.

14. The method of manufacture of claim 13, wherein the smooth side of the lid and the first side of the body form a continuous, flat surface.

15. The method of manufacture of claim 13, wherein the body comprises the first side and a second side, wherein the first side is axially offset from the second side along a longitudinal axis of the body.

16. The method of manufacture of claim 15, wherein the first side has a first length along the longitudinal axis and the second side has a second length along the longitudinal axis, and the first length is shorter than the second length.

17. The method of manufacture of claim 15, wherein the body comprises the first side, the second side, a third side, and a fourth side, wherein the hinge mechanism is disposed between the first side and the second and extends between the third side and the fourth side.

18. The method of manufacture of claim 13, wherein the hinge mechanism includes a hinge with a spring disposed around the hinge.

* * * * *